US006827426B2

(12) United States Patent
Moon et al.

(10) Patent No.: US 6,827,426 B2
(45) Date of Patent: Dec. 7, 2004

(54) METHOD FOR FABRICATING PLASMA DISPLAY PANEL

(75) Inventors: Eun A Moon, Seoul (KR); Young Jae Cho, Seoul (KR); Ji Hoon Sohn, Anyang (KR); Bum Jin Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/337,315

(22) Filed: Jan. 7, 2003

(65) Prior Publication Data

US 2003/0189605 A1 Oct. 9, 2003

(30) Foreign Application Priority Data

Apr. 4, 2002 (KR) ..... 10-2002-0018634

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,951,350 A * 9/1999 Aoki et al. ..... 445/24

* cited by examiner

*Primary Examiner*—Raquel Yvette Gordon
(74) *Attorney, Agent, or Firm*—Birch, Stewart, Kolasch & Birch, LLP

(57) ABSTRACT

A method for fabricating a plasma display panel can improve contrast of a panel by using an inkjet printing method in forming a fluorescent layer in the fabrication process of the plasma display panel. Also, after charging a liquid flake of fluorescent ink with a charge of a predetermined polarity, contrast of the panel can be improved by inducing the injection direction of the liquid flake by charging an address electrode with a charge having an opposite polarity to the liquid flake so that the charged liquid flake can be printed in the center portion of the cell region.

4 Claims, 4 Drawing Sheets

METHOD FOR FABRICATING PLASMA DISPLAY PANEL

This nonprovisional application claims priority under 35 U.S.C. § 119(a) on Patent Application No. 2002-0018634 filed in KOREA on Apr. 4, 2002, which is herein incorporated by reference.

BACKGROUND OF THE INVENTION

1. Field of the Invention

The present invention relates to a method for fabricating a plasma display panel and particularly, to a method for fabricating a plasma display panel, capable of improving contrast of the panel by preventing a fluorescent layer from being formed in an upper portion of a partition.

2. Description of the Background Art

FIG. 1 is a cross-sectional view showing a general plasma display panel. As shown in the drawing, the plasma display panel includes an upper substrate 101 for displaying an image, a sustain electrode 102 which is abutted on the lower portion of the upper substrate 101, and is at right angles to an address electrode which will be described hereinafter in a cell region of the panel, a bus electrode 103 which is positioned at a portion of the lower portion of the sustain electrode 102, a dielectric film 112 which is positioned on the lower front surface of the upper substrate 101, a protection film 111 which is formed in the lower portion of the dielectric film 112 and is abutted on a partition which will be described hereinafter, for protecting the dielectric film 112, a lower substrate 106 which is combined in parallel with the upper substrate 101 in a positioned separated in the lower direction of the upper substrate 101, a bottom plate film 107 which is positioned in the upper portion of the lower substrate, 106 for reflecting visible light, the address electrode 105 which is positioned in the upper portion of the bottom plate film 107, for generating discharging with the sustain electrode 102 in the cell region, a dielectric film 108 which is positioned on the upper front surface of the address electrode 105 and bottom plate film 107, the partition 109 which is positioned in the upper portion of the partition 109, for dividing the cell region, a black matrix which is positioned in the upper portion of the partition 109, and a fluorescent layer 104 which is formed on the side surface of the partition 109 and in the upper portion of the dielectric film 108 in a predetermined thickness, for generating respective R, G and B visible rays by ultraviolet rays.

Hereinafter, the conventional method for fabricating the plasma display panel with the above composition will be described as follows.

Firstly, the bottom plate film 107 for reflecting visible rays is formed in the upper portion of the lower substrate 106 which is a glass substrate. The address electrode 105 which is transparent and lengthened in a predetermined direction that Indium Tin Oxide (ITO) is coated and patterned is formed in the upper portion of the bottom plate film 107, the dielectric film 108 is deposited on the upper front surface of the address electrode 105 and bottom plate film 107, and the partition 109 for defining the cell region in the upper portion of the dielectric film 108 is formed. Also, a black matrix is formed in the upper portion of the partition 109, and the fluorescent layer 104 is printed inside the cell region which is defined with the partition 109, black matrix and dielectric film 108 using the screen printing method. At this time, to form a fluorescent layer 104 by the screen printing method, fluorescent paste is printed several times to completely fill the paste inside the cell region and is dried at temperature of 120~150° C. The above process is repeated in the cell regions corresponding to the colors about the R, G and B colors. Through the process, preparation of the lower plate is completed by forming a fluorescent layer 104 respectively corresponding to R, G and B in the cell regions and then calcining it at temperature of 350~450° C.

Also, the sustain electrode 102 and bus electrode 103 are formed at the lower portion of the upper substrate 101, the dielectric film 112 is formed in the lower portion of the sustain electrode 102 and bus electrode 103, and then a protection film 111 for protecting the dielectric film 112 is formed in the lower portion of the dielectric film 112. Generally, the protection film 111 is a film composed of MgO, and preparation of the upper plate is completed by forming the protection film 111.

Then, discharging gas is injected in the cell region through an injection port after combining the upper and lower plates so that the injection port is formed between the upper and lower plates. At this time, the injected discharging gas is composed of He, Ne and Xe. As described above, the fluorescent layer 104 is excited by ultraviolet rays generated in the discharging gas, and the visible ray of colors displayed by the fluorescent layer 104 is displayed on the panel.

However, the method for forming a fluorescent layer using the screen printing method had an advantage that the equipments of the process could be purchased at low costs, but contrast of the panel was decreased since the fluorescent layer could be easily formed in the upper portion of the partition 109 or in the upper portion of the black matrix.

SUMMARY OF THE INVENTION

Therefore, an object of the present invention is to provide a method for fabricating a plasma display panel, capable of improving contrast of a panel by forming a fluorescent layer using an inkjet printing method.

Also, the present invention is to provide a method for fabricating a plasma display panel, capable of improving contrast of the panel by charging a liquid flake of fluorescent ink with electricity to have a predetermined polarity, applying a voltage having a polarity opposite to the charged state to an address electrode, and preventing the fluorescent material from being printed on the upper portion of the partition.

To achieve these and other advantages and in accordance with the purpose of the present invention, as embodied and broadly described herein, there is provided a method for fabricating a plasma display panel, including the steps of sequentially forming a bottom plate film and an address electrode on an upper portion of a lower substrate, forming a dielectric film in the upper portion of the bottom plate film and address electrode, defining a cell region by forming a partition in the upper portion of the dielectric film and forming a fluorescent layer using an inkjet printing method in the cell region.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

The method for fabricating a plasma display panel in accordance with the present invention forms a fluorescent layer by using an inkjet printing method and induces the injection direction of the liquid flake by charging an address electrode with a charge having a polarity opposite to the liquid flake so that the charged liquid flake can be printed in the center portion of the cell region, after charging a liquid flake with a charge of a predetermined polarity.

Hereinafter, the method for fabricating the plasma display panel in accordance with the present invention will be described with reference to the accompanied drawings.

Figure 1:
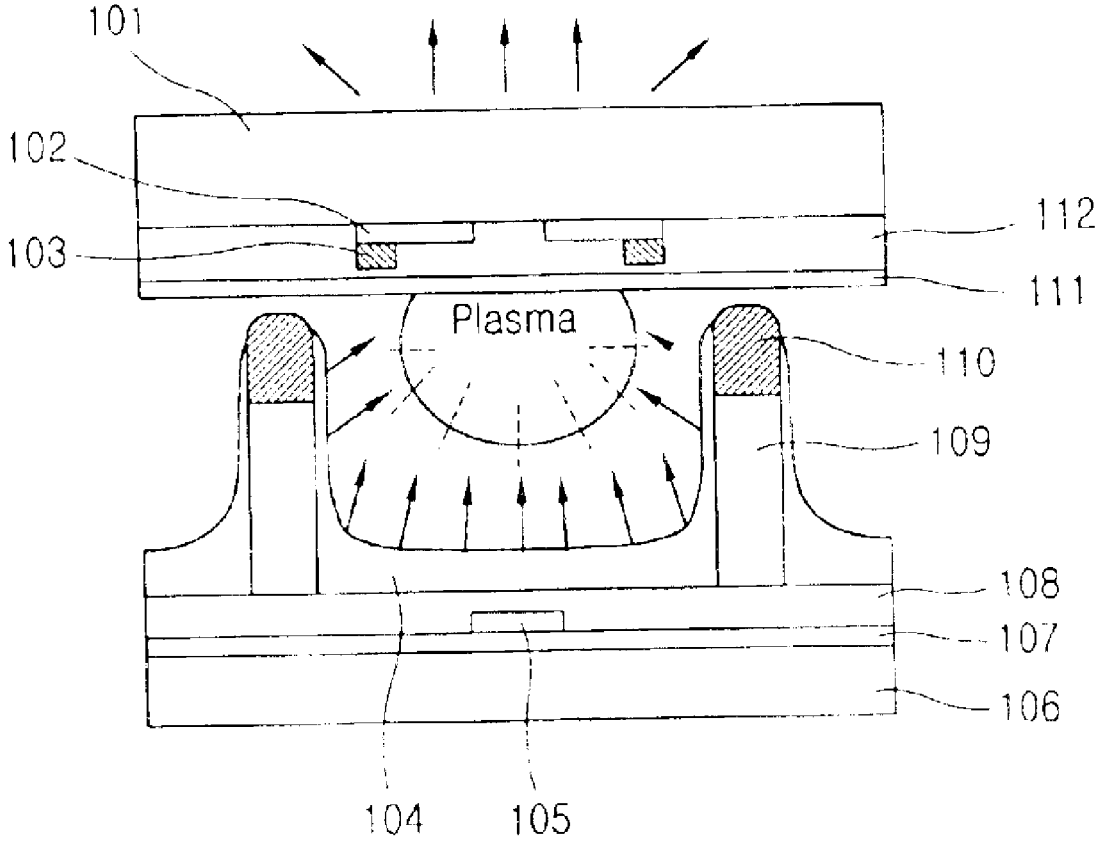
FIG. 1 CONVENTIONAL ART
FIG. 1 is a cross-sectional view showing a general plasma display panel.
Figure 2:
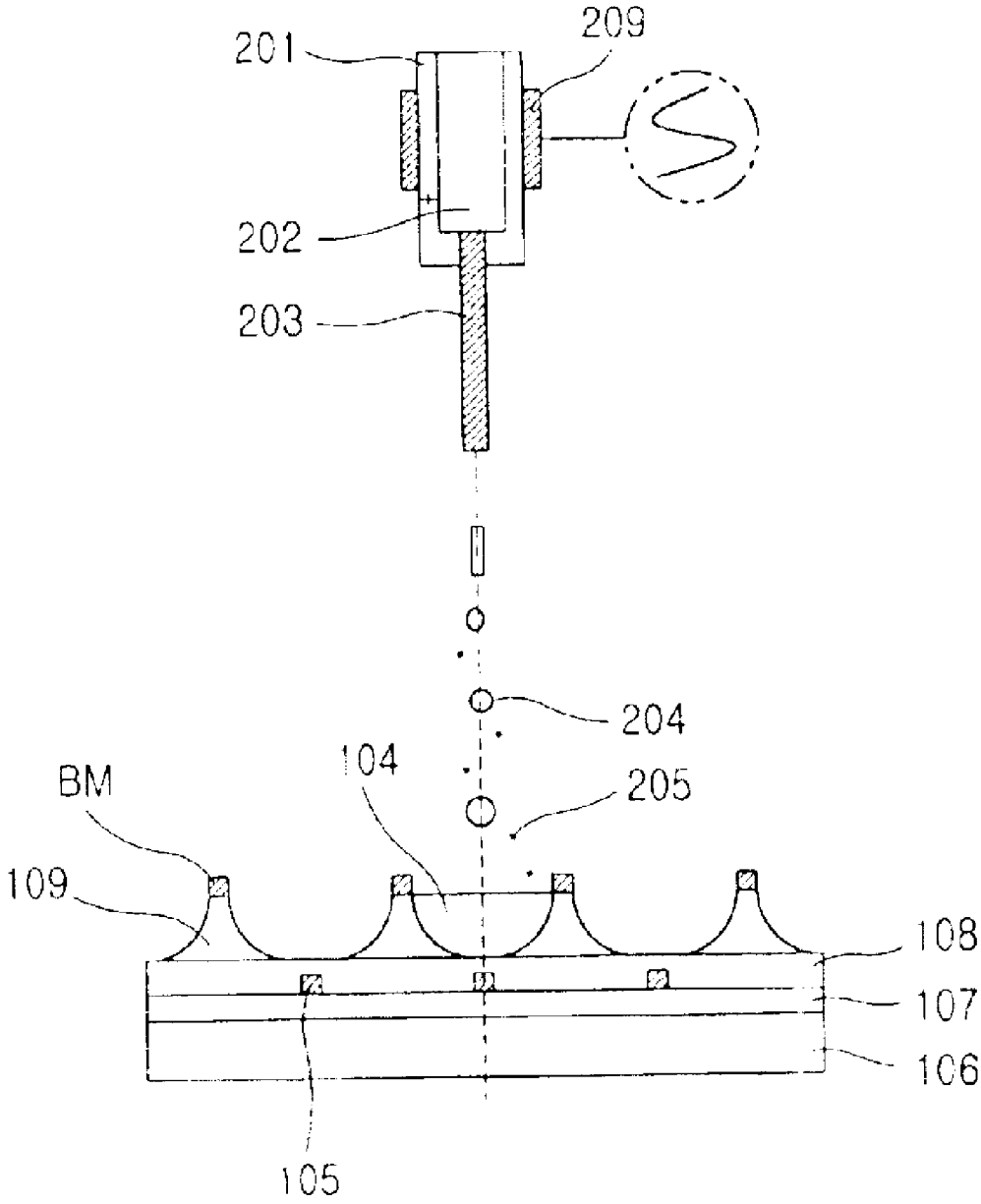
FIG. 2 is a view showing a structure of an inkjet printing apparatus in accordance with a first embodiment of the present invention.

FIG. 2 is a view showing a structure of an inkjet printing apparatus in accordance with the first embodiment of the present invention. As shown in the drawing, the inkjet printing apparatus includes fluorescent ink 202 which is composed of fluorescent substance and an organic binder, an inkjet head 201 for storing the fluorescent ink 202, a pressurizing means 206 for injecting the fluorescent ink by pressurizing the inkjet head 201, and a nozzle 203 which performs a function as a path where the fluorescent ink is injected.

The method for forming a fluorescent layer using an inkjet printing apparatus with the above composition will be described as follows.

When the fluorescent head is pressurized with a predetermined force, the fluorescent ink 202 is injected to the panel through the nozzle 203 and a fluorescent layer is formed in the cell region. At this time, the liquid flake 204 of the fluorescent ink has a diameter of 50

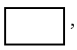

and since the size of a printed cell region is 200~350 $\mu$m, formation of the fluorescent layer is less occurred on the partition when compared with the screen printing method.

However, since a general fluorescent particle has a larger specific gravity and size, homogeneity of the fluorescent ink is decreased, and many satellites 205 are generated. Since the satellites have lower straightness and speed than the liquid flake 204, the satellites can be printed in the upper portion of the black matrix which is positioned in the upper portion of the partition regardless of the injection direction of the fluorescent ink 202 of the inkjet printing apparatus.

Figure 3:
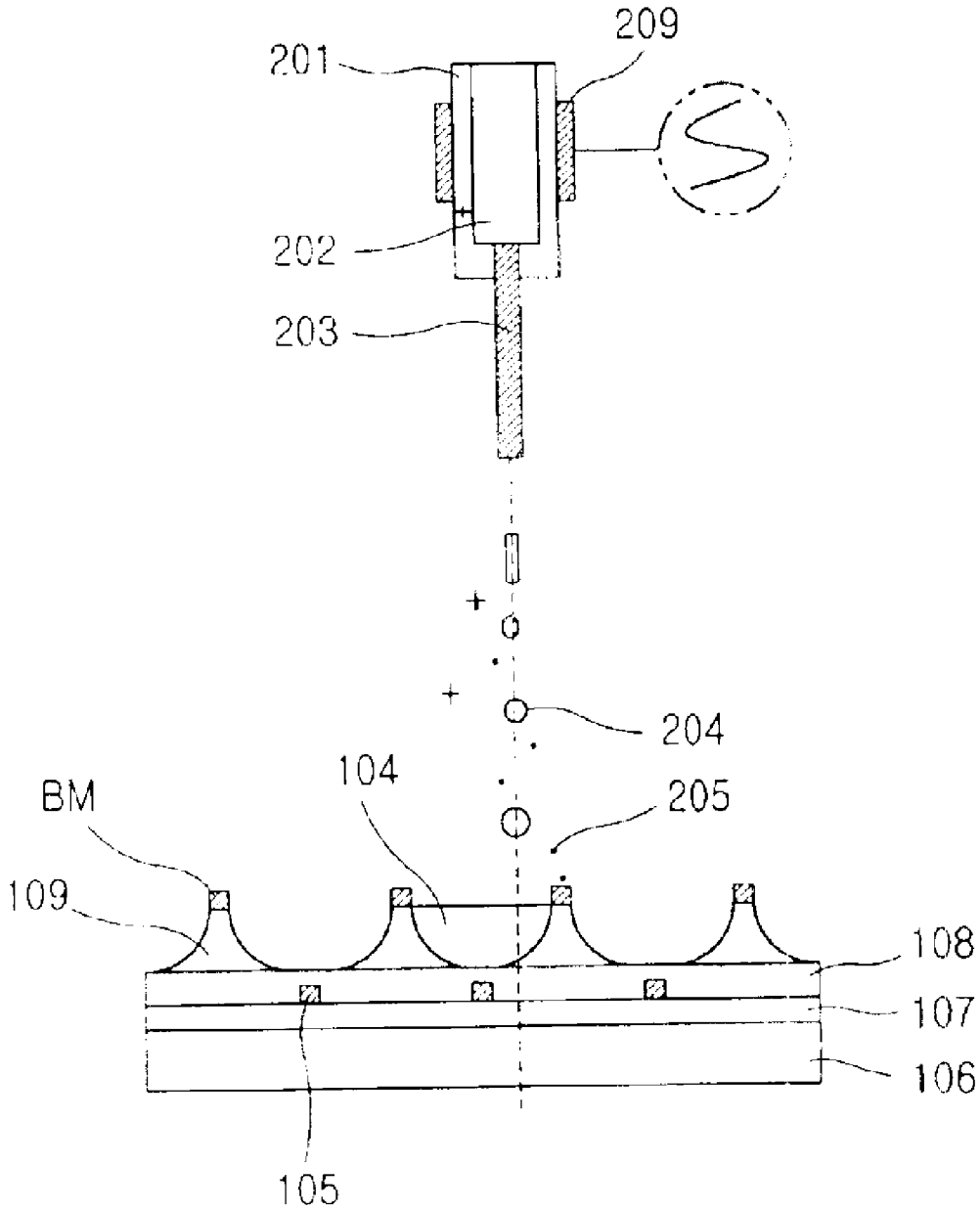
FIG. 3 is a view illustrating a case that an inkjet head and a center position of a cell region which will be printed are miss-aligned.

Particularly, as shown in FIG. 3, in case alignment of the injection direction of the nozzle 203 and the cell regions to be printed is not precisely set, since the satellite 205 is printed in the upper portion of the black matrix, color mixture of the R, G and B is occurred in the panel.

The above case can be coped with the second embodiment of the present invention.

Figure 4:
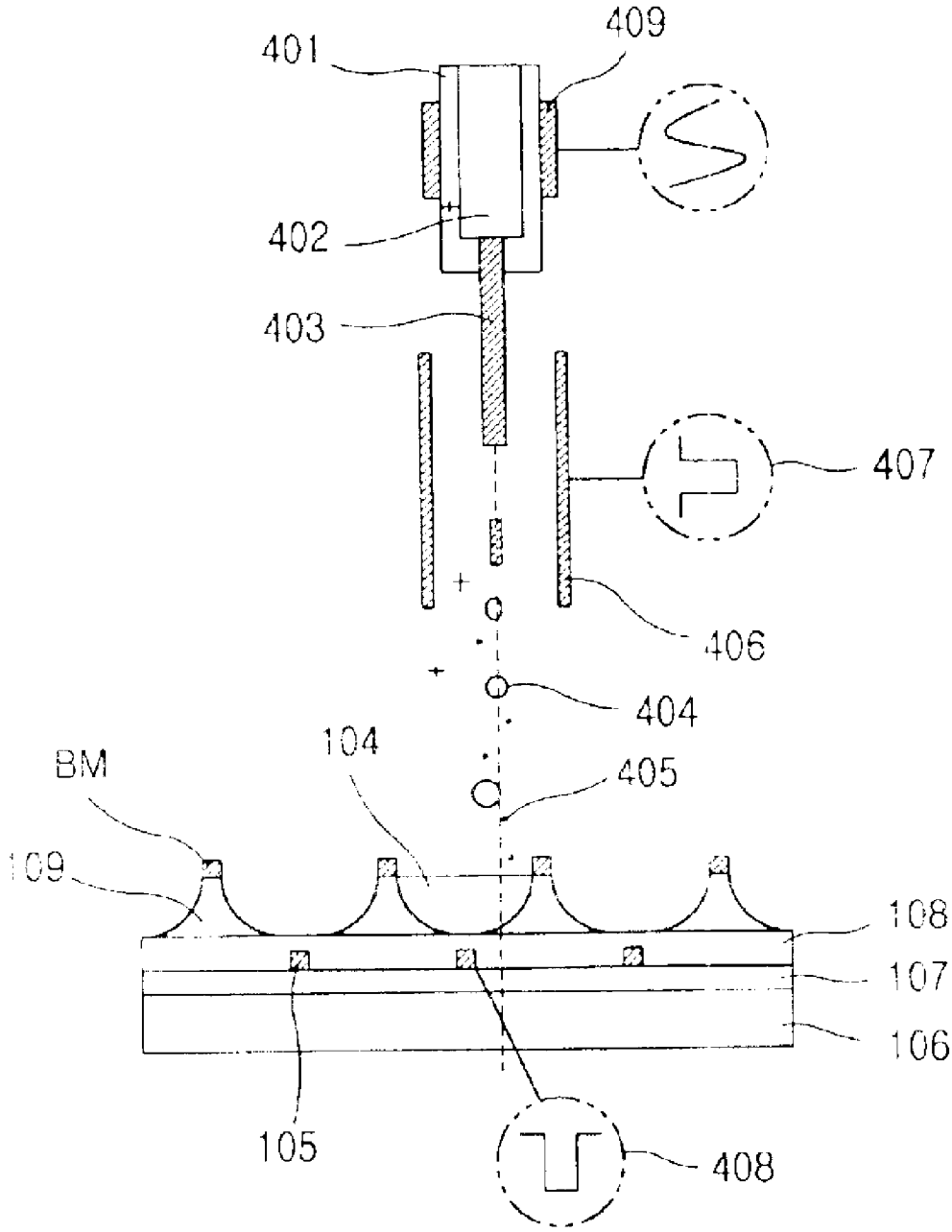
FIG. 4 is a view showing a structure of the inkjet printing apparatus in accordance with a second embodiment of the present invention.

FIG. 4 is a view showing the structure of the inkjet printing apparatus in accordance with the second embodiment of the present invention. As shown in the drawing, the inkjet printing apparatus includes fluorescent ink 402 which is composed of fluorescent substance and an organic binder, an inkjet head 401 for storing the fluorescent ink 402, a pressurizing means 409 for injecting the fluorescent ink by pressurizing the inkjet head 401, and a nozzle 403 which performs a function as a path where the fluorescent ink 402 is injected, a charge electrode 406 for charging a liquid flake which will be described hereinafter, a first power supply unit 407 for supplying a charge to have the liquid flake which passes the charge electrode 406 show a predetermined polarity, and a second power supply unit 408 for supplying a charge having a polarity opposite to that of the charge supplied from the first power supply unit 407 to the address electrode 105. At this time the fluorescent ink 402 is injected through the nozzle and divided into a liquid flake 404 and a satellite 405 according to the size of the fluorescent ink 402.

The method for manufacturing the plasma display panel using the inkjet printing apparatus in accordance with the present invention will be described as follows.

Firstly, a bottom plate film 107 for reflecting visible rays is formed in the upper portion of the lower substrate 106 which is a glass substrate. In the upper portion of the bottom plate film 107, a transparent address electrode 105 which is lengthened in a direction that Indium Tin Oxide (ITO) is coated and patterned is formed. Then, a dielectric film 108 is formed on the upper front surface of the address electrode 105 and bottom plate film 107, and the partition 109 for defining a cell region is formed in the upper portion of the dielectric film 108. At this time, as shown in FIG. 4, the address electrode 105 is positioned in the lower center portion of the cell region.

Then, the black matrix is formed in the upper portion of the partition 109, and fluorescent substance is printed in the cell region defined by the partition 109, black matrix and dielectric film 108 using the inkjet printing method. At this time, when a voltage is supplied from the first power supply unit 407 to the charge electrode 406, the charge electrode 406 charges the liquid flake 404 which is injected from the nozzle 403 with a positive charge. Then, the liquid flake 404 is injected under the condition that it is charged with a positive charge. At this time, the satellite 405 as well as the liquid flake 404 is also charged with the positive charge.

On the other hand, when a negative voltage opposite to the charging state of the liquid flake 404 and satellite 405 is applied to the address electrode 105 is applied from the second power supply unit 408, due to attractive force among the address electrode 105, liquid flake 404 and satellite 405, the progressive direction of the liquid flake 404 and satellite 405 is converted into the direction of the address electrode 105. Therefore, the satellite 405 can be prevented from being printed in the upper portion of the black matrix.

Then, the fluorescent paste is printed to be filled inside the cell region several times, and it is dried at 120~150° C. The above process is repeated respectively for R, G, and B in the cell region corresponding to the colors. The above process is repeated for the R, G and B in the cell regions corresponding to the colors. By such process, the fluorescent layers 104 indicating the R, G and B are formed in the cell regions, and then the by calcining the layer 104 at 350~450° C., preparation of the lower plate is completed.

Also, the sustain electrode 102 and bus electrode 103 are formed in the lower portion of the upper substrate, the dielectric film 112 is formed in the lower portion of the sustain electrode 102, bus electrode 102 and upper substrate 101, and the protection film 111 for protecting the dielectric film 112 is formed. Generally, the protection film 222 is a film composed of MgO, and preparation of the upper plate is completed by forming the protection film 110.

Finally, after combining the upper and lower plates to form a gas injection port, discharging gas is injected through the injection port. At this time, the discharging gas is composed of He, Ne and Xe. The fluorescent layer 109 is excited by ultraviolet rays generated in the discharging gas, and visible rays of colors displayed by the respective fluorescent layers are displayed in the panel.

As described above, in the method for fabricating the plasma display panel, contrast of the panel can be improved by forming the fluorescent layer using the inkjet printing method.

Also, in the method for fabricating the plasma display panel, contrast of the panel can be improved by preventing the fluorescent substance from being printed in the upper portion of the partition, by charging the liquid flake of the fluorescent ink to have a predetermined polarity and applying a voltage having an opposite polarity to the charging state to the address electrode.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for fabricating a plasma display panel, comprising the steps of:

sequentially forming a bottom plate film and an address electrode on an upper portion of a lower substrate;

forming a dielectric film in the upper portion of the bottom plate film and address electrode;

defining a cell region by forming a partition in the upper portion of the dielectric film;

charging fluorescent ink which is injected from a nozzle with electric charge having a predetermined polarity; and applying a voltage having a polarity opposite to the charging state of the fluorescent ink to the address electrode.

2. The method of claim 1, wherein the fluorescent ink is charged with positive electric charge, and a negative voltage is applied to the address electrode.

3. A method for fabricating a plasma display panel, comprising the steps of:

defining a cell region by forming a partition in the upper portion of the dielectric film after sequentially forming a bottom plate film and address electrode in the upper portion of the lower substrate and forming a dielectric film in the upper portion of the bottom plate film and address electrode, and then preparing a lower plate by forming a fluorescent layer using an inkjet printing method in the cell region;

forming a sustain electrode and a bus electrode, forming a dielectric film in the lower portion of the sustain electrode, bus electrode and an upper substrate, and preparing an upper plate by forming a protecting film for protecting the dielectric film in the lower portion of the dielectric film; and injecting discharging gas into the cell region through an injection port after combining the upper and lower plates to form the gas injection port, wherein the step preparing the lower plate by forming the fluorescent layer includes the steps of;

charging fluorescent ink injected from a nozzle with an electric charge having a predetermined polarity; and applying a voltage of the polarity which is opposite to the charging state of the fluorescent ink to the address electrode.

4. The method of claim 3, wherein the fluorescent ink is charged with a positive charge, and a negative voltage is applied to the address electrode.

* * * * *